US005526568A

United States Patent [19]

Copelan

[11] Patent Number: 5,526,568

[45] Date of Patent: Jun. 18, 1996

[54] RAZOR WITH SWITCH FOR PERPENDICULAR AND LIMITED OBLIQUE ANGLE SHAVING

[76] Inventor: Herbert W. Copelan, 8706 Via Reale, Boca Raton, Fla. 33496

[21] Appl. No.: 173,421

[22] Filed: Dec. 23, 1993

[51] Int. Cl.[6] ..... B26B 21/52

[52] U.S. Cl. ..... 30/89; 30/87

[58] Field of Search ..... 30/89, 47, 48, 30/34.05, 87

[56] References Cited

U.S. PATENT DOCUMENTS

| | | | |
|---|---|---|---|
| 831,259 | 9/1906 | Bingler | 30/89 X |
| 845,628 | 2/1907 | Gaylor . | |
| 1,048,154 | 12/1912 | Harley . | |
| 1,247,266 | 11/1917 | Hartman . | |
| 1,247,581 | 11/1917 | Seitz | 30/89 |
| 1,589,826 | 6/1926 | Strand . | |
| 1,633,139 | 6/1927 | Staats-Oels . | |
| 1,795,956 | 3/1931 | Kynnersley . | |
| 1,824,338 | 9/1931 | Finn . | |
| 1,950,073 | 3/1934 | Trachtenberg . | |
| 1,995,232 | 3/1935 | Tipery . | |
| 2,002,298 | 5/1935 | Segal . | |
| 2,275,517 | 3/1942 | Fay | 30/354 |
| 2,319,980 | 5/1943 | Jardins | 30/50 |
| 2,787,831 | 4/1957 | Siegel | 30/48 |
| 3,783,510 | 1/1974 | Dawidowicz et al. | 30/32 R |
| 3,964,160 | 6/1976 | Gordon | 30/89 |
| 4,083,103 | 4/1978 | Estandian | 30/47 |
| 4,128,937 | 12/1978 | Adorney | 30/47 |
| 4,663,843 | 5/1987 | Savage | 30/48 |
| 5,033,152 | 7/1991 | Althaus | 30/89 |
| 5,070,614 | 12/1991 | Hardin et al. | 30/87 |
| 5,093,991 | 3/1992 | Hendrickson | 30/89 |

FOREIGN PATENT DOCUMENTS

| | | | |
|---|---|---|---|
| 511980 | 8/1939 | United Kingdom | 30/89 |

*Primary Examiner*—Douglas D. Watts

*Attorney, Agent, or Firm*—Dann, Dorfman, Herrell and Skillman; Roger W. Herrell

[57] ABSTRACT

To provide the advantages of optional oblique shaving while retaining the advantages of conventional, perpendicular shaving, a razor is provided with a conventional, disposable razor blade unit; a joint that allows the blade unit to be held either at the conventional perpendicular position or at one, specific oblique angle; and a switching mechanism that allows convenient and safe conversion from either angle to the other. The mechanism is controlled by the hand holding the razor, without changing the hand's position and without interrupting shaving. A safety brake prevents a change in angle when the blade unit is in close contact with the skin.

9 Claims, 6 Drawing Sheets

RAZOR WITH SWITCH FOR PERPENDICULAR AND LIMITED OBLIQUE ANGLE SHAVING

FIELD OF THE INVENTION

The present invention relates to safety razors, and more particularly to adjustable safety razors.

BACKGROUND OF THE INVENTION

The cutting efficiency of an instrument depends in large part on the angle between the long axis of the cutting edge and the direction of the cutting stroke, the blade-stroke angle. An oblique, or slicing, angle is more efficient than a perpendicular, chopping one. Oblique cutting has been used from the early stone knife and flat arrowhead to the scythe, saber and scimitar, sawtooth, scissors and even the guillotine. The axe and modern safety razor are the only common tools that use a perpendicular angle and chop, rather than slice. In fact, the axe is often made with a curved blade or used with a slicing stroke, and some prehistoric, bronze age razors had curved blades so as to shave obliquely. The modern, conventional wet safety razor, however, still uses only a perpendicular angle and cuts by hacking, i.e. perpendicular chopping.

Compared to perpendicular chopping, oblique slicing cuts more smoothly and the cutting edge remains sharp longer. Oblique razors have not been successful, however, despite many attempts, as evidenced by more than twenty United States patents granted from 1880 through 1992. The inventions failed for several reasons.

Razors that shaved only obliquely were unsuitable to shave near the sideburns, lips or nose, where perpendicular shaving is easier and safer. Oblique razors that also shaved perpendicularly were costly and cumbersome. Further, these razors generally did not ensure an optimum oblique angle; most were rotary, allowing angles over a 360° range. Oblique angles outside a narrow range are undesirable. Small angles are not worthwhile; large ones excessively reduce the area shaved by each stroke. Further, a widely angled blade passes too deeply over raised surfaces and cuts skin with the same efficiency as it cuts hair, while it skips depressed surfaces. Excessive obliquity cuts the skin, also, because the effective distance of the blade guard from the following blade is significantly increased. Dumas (U.S. Pat. No. 4,791,724) and Gorden (U.S. Pat. No. 3,964,160) patented razors that shaved perpendicularly and at safer oblique angles, but both needed special razor heads, and Gorden allowed ineffective oblique angles. Dumas's razor shaved perpendicularly and was incidentally limited to one oblique angle by the "V" arrangement of its unusual cartridges.

All razors that shaved both obliquely and perpendicularly were inconvenient to convert back and forth, requiring that shaving be interrupted to change the angle. The fingers or the hand had to be displaced, or both hands were needed. Althaus' razor (U.S. Pat. No. 5,033,152) had a spring to return its blade unit automatically to a single neutral position, but the razor had no specific oblique angle. The spring merely allowed the blade to be passively deflected by chance skin surface irregularities; the razor shaved obliquely by accident and under no control.

Every previous razor had at least one major defect. A practical razor for oblique shaving must not have any. The razor must shave obliquely at an effective angle. It must not permit oblique shaving outside a limited, optimum range. It must shave perpendicularly when desired. The shift of shaving angles must be convenient; it must not interrupt shaving or require a second hand or displacement of the fingers from their normal hold on the razor. The shift in angles must be safe. The razor must be economical, preferably having a conventional blade unit, which should last longer with oblique shaving. Each of these requirements is essential.

SUMMARY OF THE INVENTION

The object of this invention is to make oblique shaving practical. The method is to use the option and advantages of conventional, perpendicular shaving; to ensure oblique shaving at a safe and effective shaving angle; to interchange the shaving angle safely and conveniently; and to be economical.

The means of the invention is a razor having a conventional blade unit and a jointed handle that allows the angle of the blade unit to be set, as desired, either at the perpendicular position or at one specific oblique angle, and at no other oblique angle. The razor has a convenient switch to interchange the blade angle. The switch is operated by either hand alone and in its usual position gripping the razor handle. Changing the angle does not interrupt shaving or require displacement of the fingers or hand. The razor also has a mechanism that prevents the shaving angle from changing when the blade edge is pressing against the skin.

DETAILED DESCRIPTION OF THE INVENTION

Figure 1:
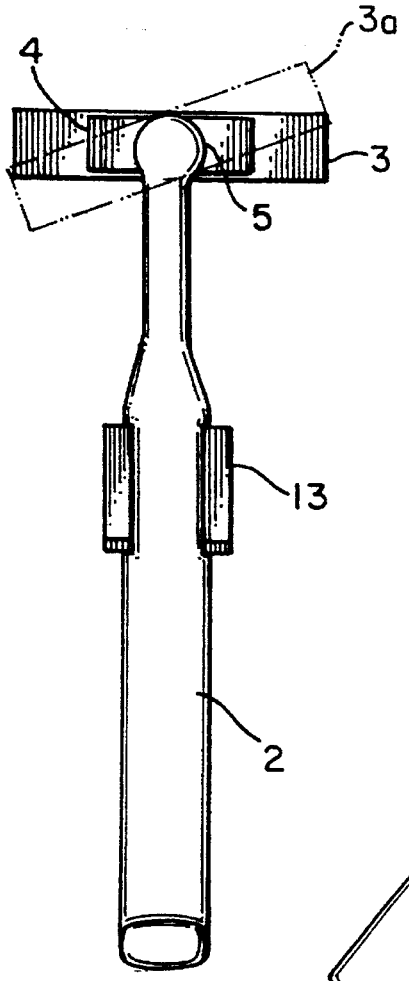
FIG. 1 is a front view of a preferred, exemplary embodiment of the invention. The view is perpendicular to a surface that would be shaved. The razor handle is angled toward the observer. The handle holds a conventional blade unit either at the customary, perpendicular position or at a specific, oblique angle. A joint and switching mechanism allow the angle to be changed by minimal action of two fingers of the hand holding the razor.

Specific terms are used as follows: "Razor" means wet, safety razor, i.e. one having a guard for the leading blade edge and ordinarily used with a lather or cream. "Blade unit" means razor blade, blade assembly, or blade cartridge. A "conventional blade unit" is one ordinarily manufactured for razors that shave at the traditional, perpendicular angle. "Blade edge axis" and "blade axis" mean the long axis of the cutting edge, or parallel edges, of the blade unit. "Shaving angle" and "blade-stroke angle" mean the angle between the blade axis and the direction of the shaving stroke, which corresponds to the long axis of the handle body as projected to the skin surface. "Blade-handle" angle means the angle between the blade axis and the projected axis of the handle; it is equivalent to the blade-stroke angle. "Perpendicular", therefore, means that the shaving angle, blade-stroke angle, blade-handle angle, blade angle and blade unit angle are all at 90°. "Oblique" means that the angle deviates from 90° by the size of the oblique angle.

The method of the invention is to shave obliquely only at an effective and safe angle, to use perpendicular shaving where it is advantageous, to conveniently and safely change from either angle to the other, and to have the ease, economy and safety of conventional, perpendicular shaving.

The preferred means for the invention is a single razor having five principal features.

1. The razor has a conventional blade unit that can be held or docked either at a perpendicular angle or at a specific, limited oblique angle.

No previous razor that converted from perpendicular to only one, specific oblique position used a conventional blade unit, and razors that used a conventional blade unit did not limit the oblique angle.

2. The razor has a handle with a finger tip switch and mechanism for changing the shaving angle from either position to the other. The angle shift does not require a second hand and, in the preferred embodiment, does not require displacement of the fingers or hand from their usual hold on the razor. The shift does not interrupt shaving or take more attention than is used in conventional shaving.

Previous razors that allowed the shaver to change the blade angle required that shaving be interrupted and required two hands or significant displacement of the fingers or hand gripping the razor.

3. The preferred embodiment passively maintains the shaving angle at the oblique position and automatically returns the blade angle from the perpendicular to the oblique when the shaver allows.

No previous razor automatically returned the blade unit from one specific position to another.

4. The preferred embodiment of the razor has a mechanism to prevent skin cutting when changing the shaving angle automatically.

The previous razor that automatically returned the shaving angle did not have a safety mechanism, and spring force pressed the blade edge directly against the skin.

5. The razor has a conventional blade unit. The mount varies with the particular blade unit selected. The mount and blade unit are not novel in themselves.

Figure 2:
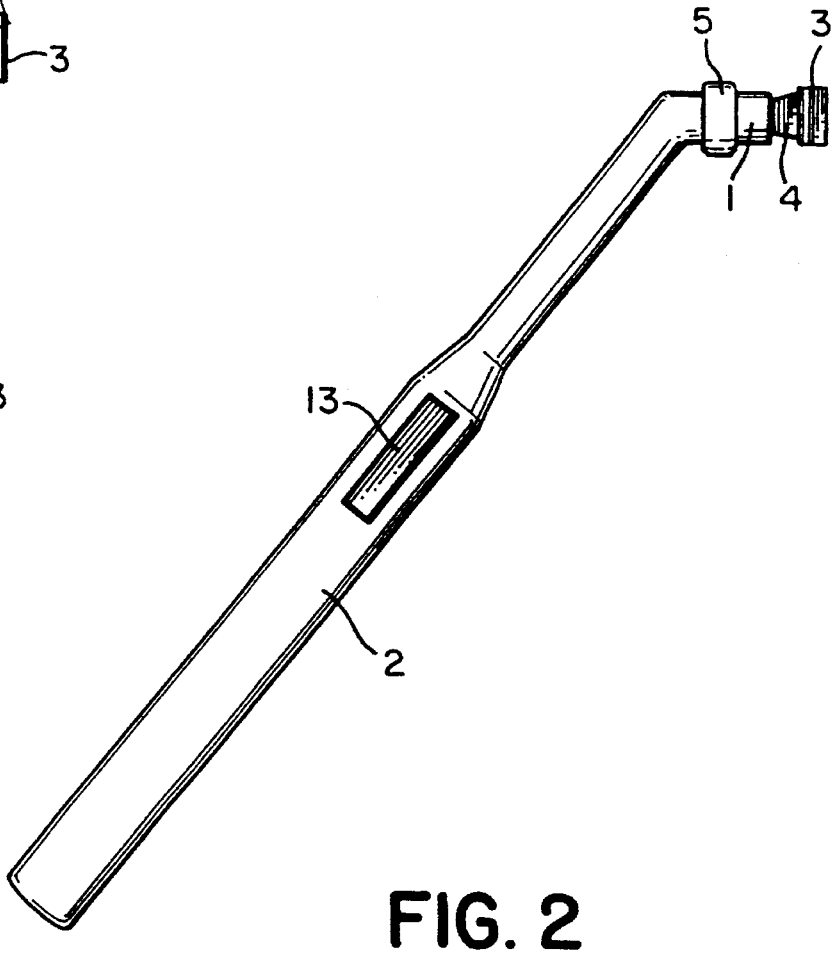
FIG. 2 is a side view of the razor shown in FIG. 1.

The exemplary embodiment is shown in approximately actual size in FIGS. 1 and 2 with the handle inclined toward an observer facing the figure. The razor has a two-part handle, a blade support (1) and a gripped body (2), and a disposable blade unit (3). The blade unit may be any of several types ordinarily made for conventional razors. The blade unit is shown in full lines in the drawings in the perpendicular position for ease of illustration, and a broken line 3*a* in FIG. 1 shows the unit in an 18° oblique position. The preferred unit is a cartridge with two blades. The blades may be movable to rise or fall with uneven skin surfaces. Such units can allow greater obliquity in the blade-stroke angle with less tendency to skin cutting. The razor's neck portion (1) accommodates a mount (4) suited to the particular blade unit. The particular mount and blade unit do not affect the operation of the razor.

Figure 3:
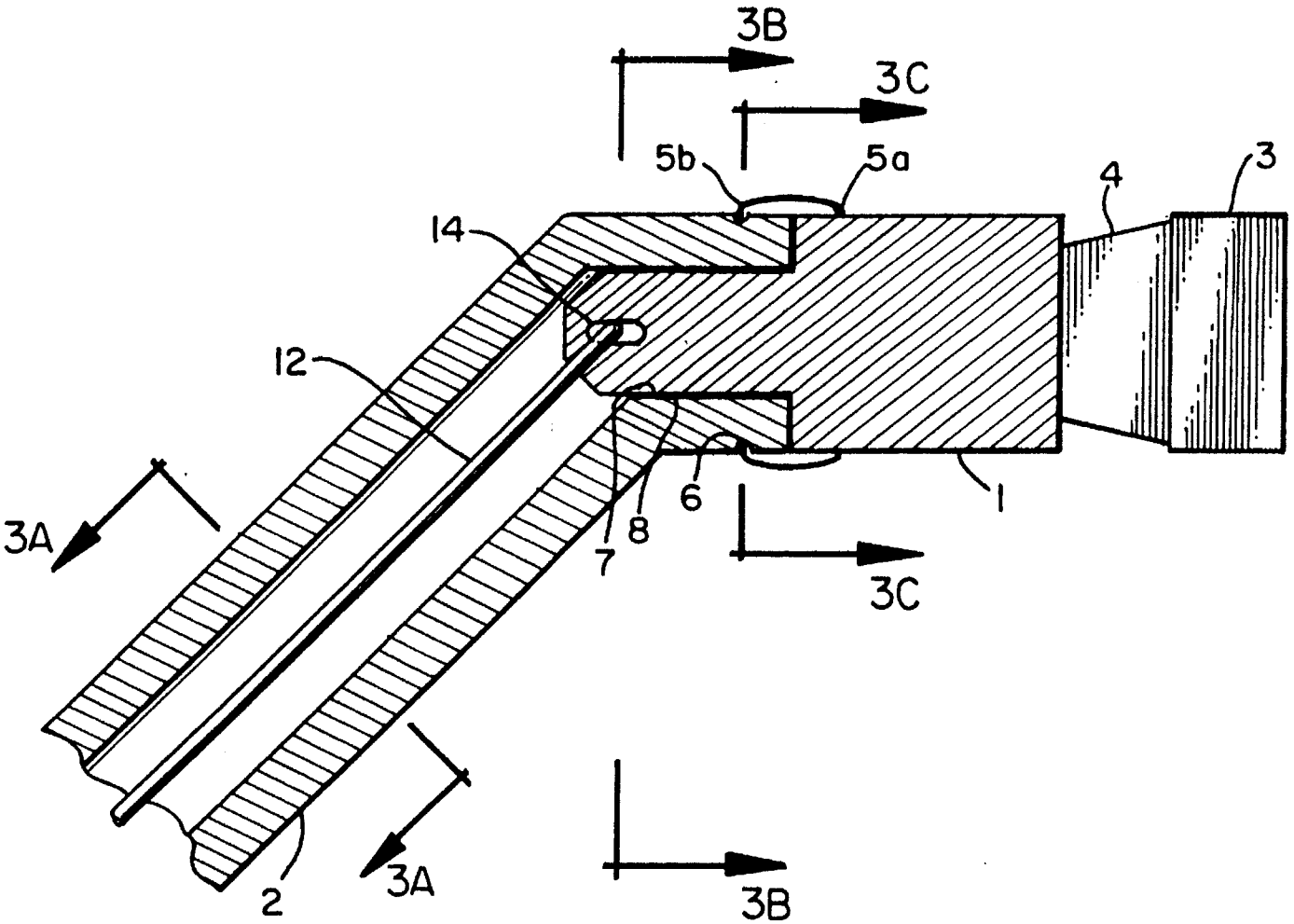
FIG. 3 is an expanded, schematic, mid-line section of the head end of the razor. The end of a control arm, which is not in the mid-line, is shown to illustrate part of the mechanism.
Figure 3A:
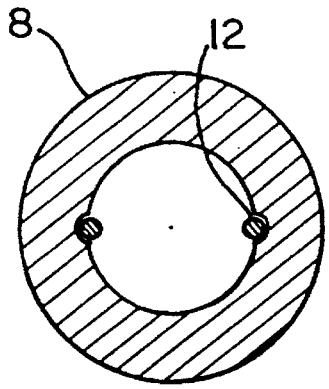
FIGS. 3A, 3B and 3C are three cross-sections as indicated by the section lines in FIG. 3, of which one (3C) is further enlarged.
Figure 3B:
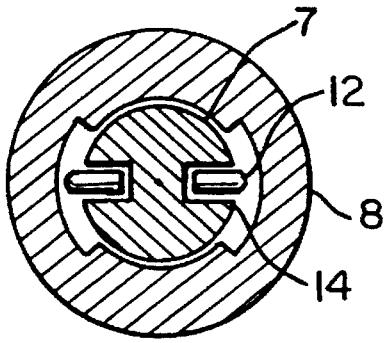
Figure 3C:
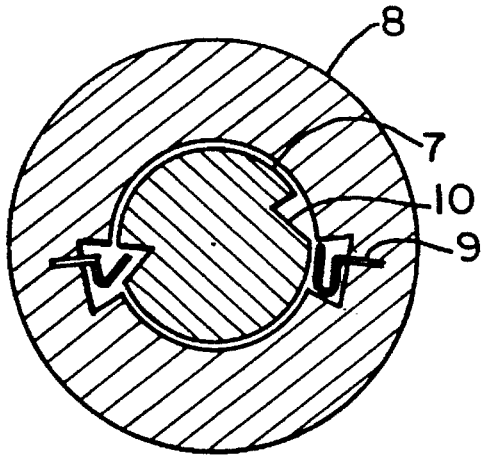

The handle of the preferred embodiment has two sections, the short blade-support "neck" (1) and body (2), which is gripped by the shaver. The neck (1) and body (2) are united by a joint which allows the neck (1) and the blade unit (4) to rotate in a plane parallel to the skin surface. The axis of rotation is perpendicular to the skin surface when the razor is in shaving position. The joint may be held together by any one of various devices, including rings, moldings, pins, bolts and others. In the illustrated embodiment, the joint is held together by a ring (5). The ring's "U"-shaped cross-section is seen in FIG. 3. One end (5*a*) of the "U" is fixed to the neck section (1) of the handle. The other end (5*b*) rides in a close-fitting track (6) circling the body section (2) of the handle. The ring can be flexible to allow it to snap in or out of the track so that the joint can be separated and reassembled. A piston-like extension (7) from the neck of the handle fits closely into a cylindrical socket section (8) of the body (2). Alternatively the razor can be made so that it may be separated for cleaning. In such embodiments, the piston extension of the handle neck can terminate as a key-like extension that fits into a receptacle. The receptacle, rather than the neck piston, is rotated by the switching mechanism. The receptacle in such embodiments is attached to the handle body so that it may rotate, turning its socket and the inserted "key". The sections may be permanently lubricated or coated to reduce friction. Rotation is limited, and the angle is lightly held, by a docking means having a spring-catch (9) and slot (10) system (see FIG. 3C). The system is spaced so that the blade-handle angle is either perpendicular or 18° oblique from the perpendicular position. The spring catches (9) are asymmetrical so that one catch (9) permits the piston (7) to rotate clockwise towards one slot (10) and the other catch (9) permits the piston (7) to rotate counter-clockwise toward the other slot (10). As shown in FIGS. 3 and 3C, passage for rotation between the predetermined arresting positions is clear and the joint interfaces are smooth to prevent setting the shaving angle at any intermediate position.

The 18° angle produces an effective cutting angle that is greater than its fixed size, because hair is displaced obliquely from the shaving stroke when being cut by an oblique blade edge, as taught by Savage (U.S. Pat. No. 4,663,843). For a fixed angle of 18°, if a hair is displaced a distance equal to its own diameter, the effective oblique angle is almost doubled. (Other cutting instruments also use small fixed oblique angles if their objects are mobile.). Movable razor blades, stiff hair and smooth skin allow angles larger than 18°. Smaller angles can be used for soft hair and sensitive or uneven skin.

Figure 4B:
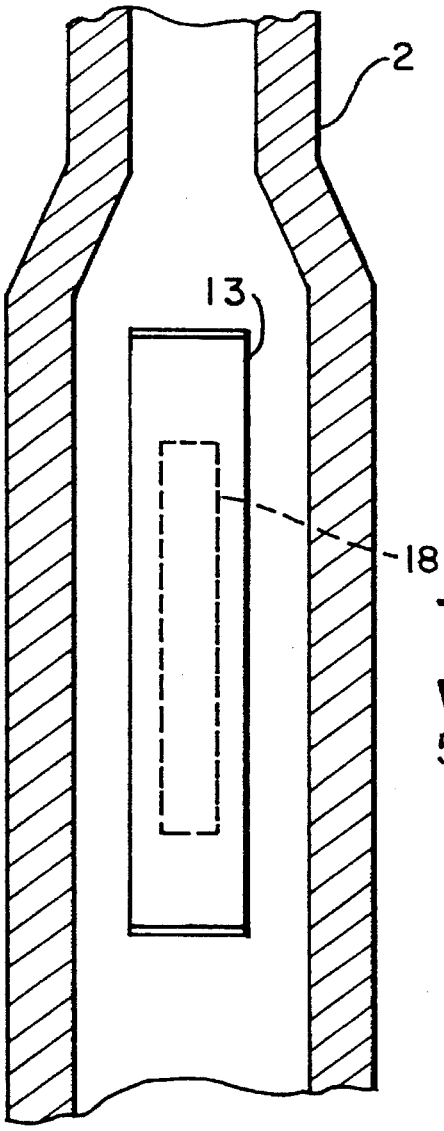
FIGS. 4A and 4B are enlarged front and side fragmentary sectional views of the handle, showing the switching mechanism in elevation in the mid-portion of the handle, including the finger-tip switches, control arms, connecting bridges, spring units (FIG. 4A), and apertures for the connecting bridges.
Figure 4A:
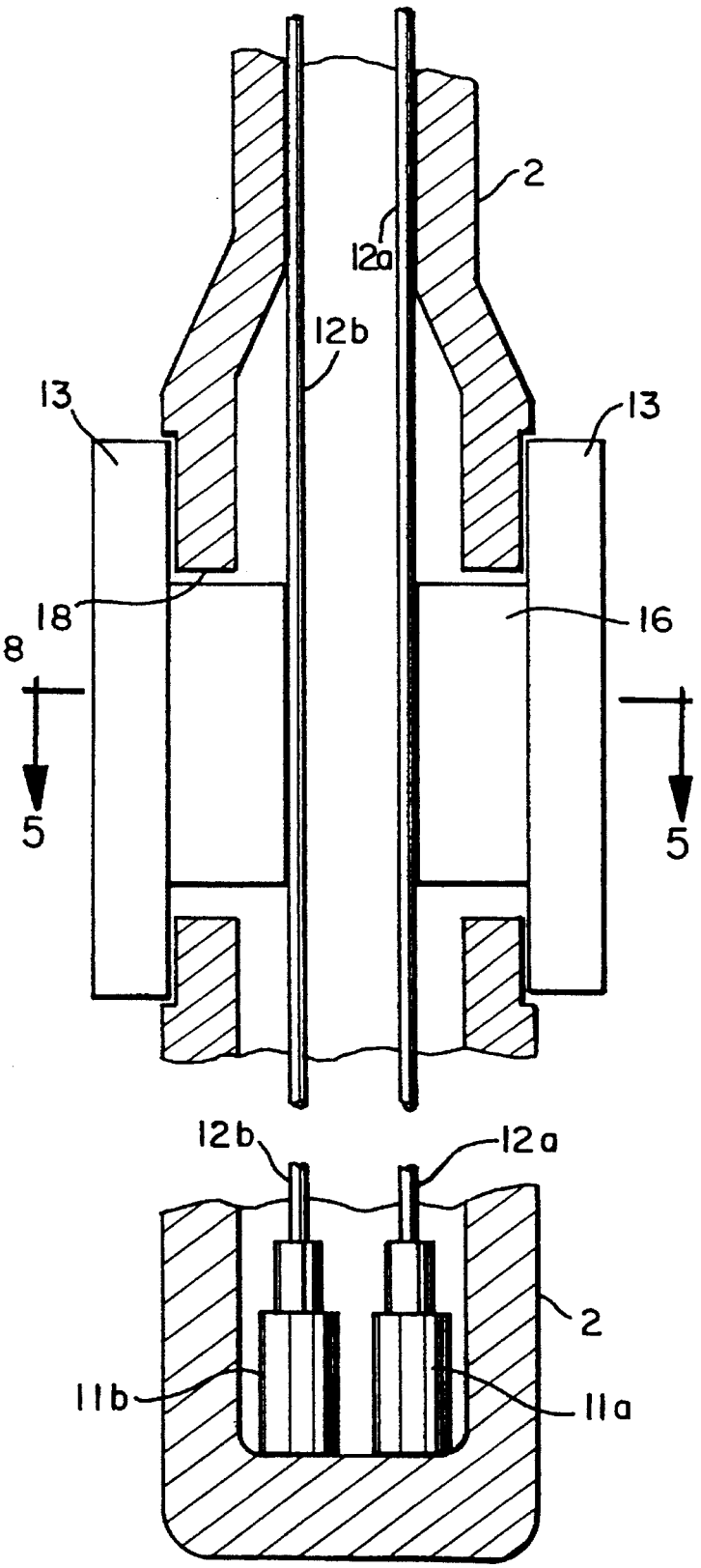

The preferred embodiment has a spring system that urges the blade unit toward the oblique angle, rather than perpendicular. The illustrated embodiment uses a compression spring (11*a*) and a traction spring (11*b*), on respective control arms (12*a* and 12*b*), as seen in FIG. 4A. Finger-tip switches (13), preferably on opposing aspects of the handle, move the control arms longitudinally of the gripped portion of the body (2) so as to change the blade unit position to perpendicular when desired. In the illustrated embodiment, the thumb and an opposing finger of the hand in its usual position on the razor are each in contact with one of the switches. Moving the two finger tips in opposite directions along the axis of the handle body overcomes the spring force to pull down (FIG. 3) one side of the piston and push up (FIG. 3) the other side, rotating the blade unit to the perpendicular position. If the razor is changed to the other hand, the finger movements are reversed. A single control arm may be used, but two arms have smoother action. The fingers use little force. The opposite movements of the finger and thumb are natural. Finger movement for the illustrated embodiment is about one millimeter and is felt as pressure as much as displacement. The change to a perpendicular angle takes little attention, which is needed only for shaving the difficult areas, when extra care is ordinarily taken.

The control arms (12*a* and 12*b*) may be allowed slight movement parallel to the axis of rotation of the neck (1) so as to compensate for obliquity between the handle body (2) and neck (1). This movement can be provided by the linkage slot (14) as in FIG. 3, by excess clearance in other possible linkage systems or by flexibility in the control arms. Alternatively, angled gears can be used in the joint, making lateral, control-arm movement unnecessary. If the razor is made for disassembly, the control arms can connect to a socket that would receive a key-like extension of the neck.

To resume oblique shaving, the shaver relaxes pressure on the switches and eases razor pressure against the face, as is normally done at the end of a shaving stroke. The stronger spring action of the control arm units then returns the blade unit to the oblique position. Because the blade unit is in the oblique position when the controls are eased, the shaver's attention is free when it is normally relaxed, i.e. when shaving the larger skin surfaces. The oblique angle, therefore, is preferred for the passive blade unit position.

Figure 5A:
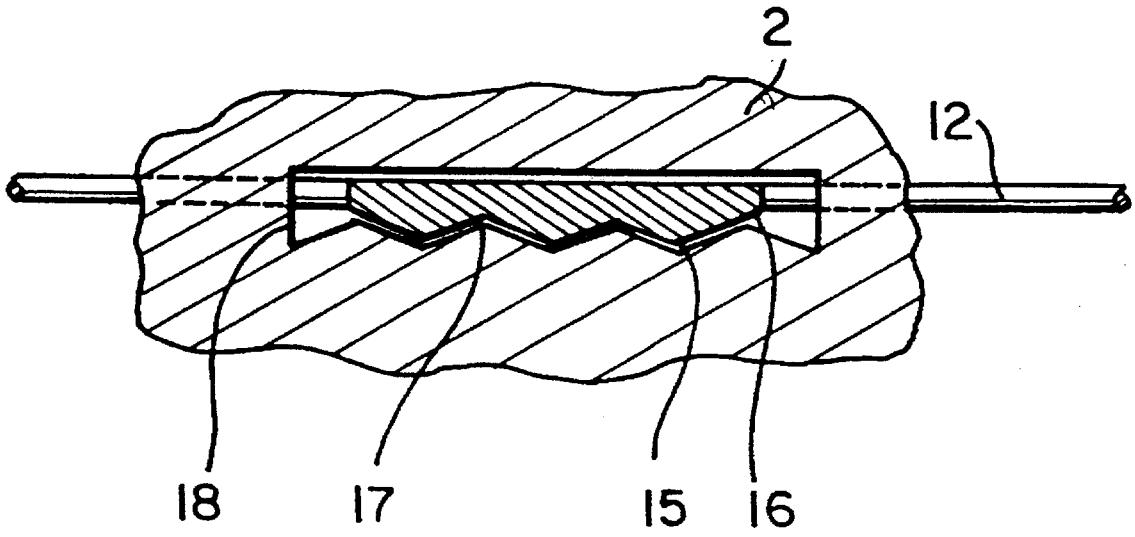
FIG. 5A is a side view of the braking teeth in the bridges and the apertures that prevent skin cutting.
Figure 5B:
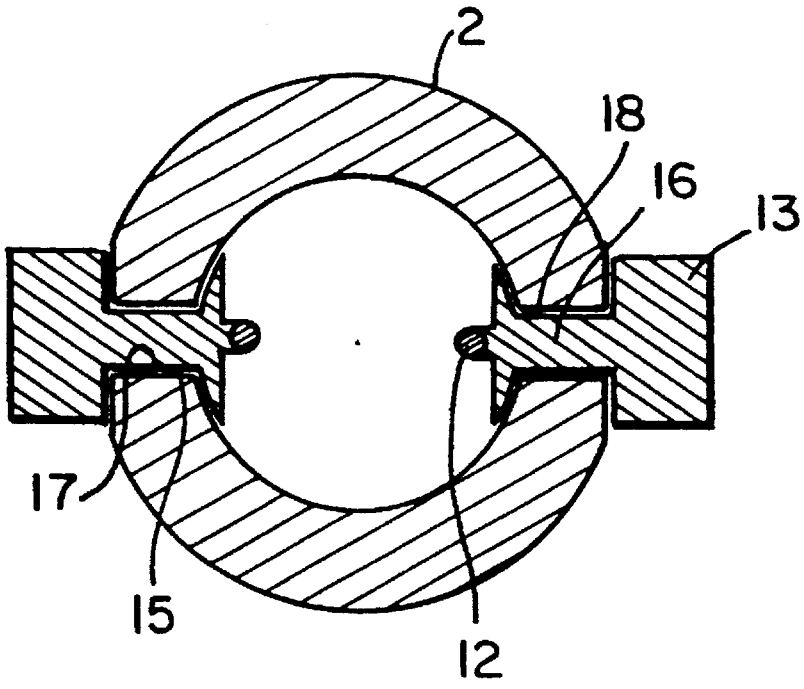
FIG. 5 is a cross-section on line 5—5 of FIG. 4A showing the switches, bridges and apertures.

If the shaver eases the finger pressure that maintained the perpendicular blade angle (i.e. pressure along the axis of the handle body) but still holds the blade unit against the face, finger pressure necessarily is acting along the axis of the handle neck to maintain skin contact. This force keeps the braking teeth (15) on the underside of each control bridge (16) meshed against the toothed upwardly-facing surface (17) of its aperture (18), as can be seen from FIGS. 5 and 5A. This prevents the angle change and possible skin cutting. A specific braking system is preferred. Otherwise, spring force could act directly against the skin when the angle changes automatically.

Figure 6A:
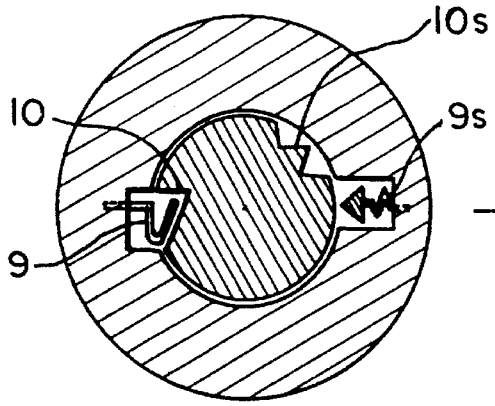
FIG. 6A is a view similar to FIG. 3C showing an alternative embodiment with multiple oblique positions.
Figure 6B:
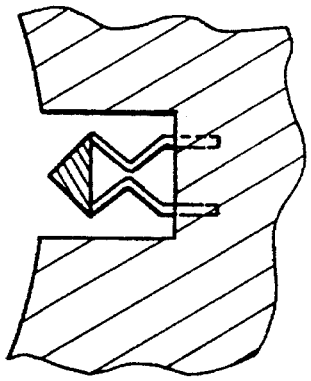
FIG. 6B is an enlarged fragmentary view of the spring catch shown in FIG. 6A.
Figure 6C:
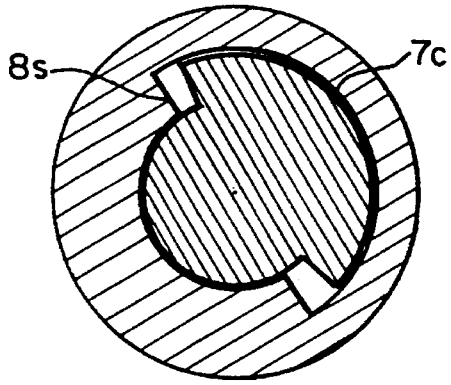
FIG. 6C is a cog-stop alternative to the system shown in 3C.

This invention can have various embodiments of its essential elements. For simplicity in use, more than in manufacture, the preferred embodiment has only a single oblique angle of about 18°, preferably to only one side of the perpendicular position. This angle was found best in my trials with subjects and is close to several previous recommendations. Angles differing from this size by more than 8° are ineffective or harmful and are inconsistent with an important principle of this invention. Several oblique angles, all within the range of 12° to 26° could be used, preferably with separate razors for each different oblique angle. Alternatively, a single razor could allow several oblique angles within the effective range. Instead of two asymmetrical slots and catches for docking controlling rotation of the piston (7) of the neck (1) in the cylindrical socket (8) of the body (2), at least one catch (9*s*) and one slot (10*s*) can be symmetrical as shown in FIG. 6A. (The catch is further enlarged in FIG. 6B). The catch (9*s*) is symmetrical, so that it can enter and leave a symmetrical slot (10*s*) from either side. The blade unit can then rotate to an oblique angle greater or less than one at a symmetrical slot-catch position. Rotation can still be limited by asymmetrical catch-slots (9 and 10) at the largest desired oblique angle and at the perpendicular position. Alternatively, docking can use a cog (7*c*)-stop (8*s*) system, as shown in FIG. 6C, can be used at one level on the piston to limit the extremes of rotation, and a symmetrical catch-slot or spline system as illustrated in FIGS. 6A and 6B can be used at another level on the piston to set intermediate angular positions. The symmetrical catch-slot or spline system can also be combined into the cog-stop elements (7C and 8*s*). The combined elements can be inserted at the level indicated by the section line 3C in FIG. 3 and would replace the asymmetrical slot-catch elements (9 and 10). Multi-angle variations greater than two are possible but multi-angle variations are less desirable and may have more commercial appeal than shaving utility. It is preferred, however, to use the particular optimum oblique angles best suited for the respective blade units for which embodiments may be made.

The preferred location of the shaving angle joint is in the handle neck, so that the rotation axis of the neck (1) is perpendicular to the skin surface and to minimize mechanical dissipation of torque to the blade unit. This location also allows space for the particular mount (4). A joint could be provided in the blade unit mount (4) or in a blade cartridge (3) having a blade assembly rotating on an axle or track. These locations have little advantage and are more difficult to manufacture.

The switches (13) may be designed so as to operate by action of the palm, but finger-tip controls are more convenient. Finger pressure directly perpendicular to the handle surface does not require force along the handle surface and can be used to change the shaving angle. An angled surface or cam on the finger switch can then act on a cam on a control arm to move the arm in the desired direction. The finger contacts for perpendicularly moving switchers can be round "buttons" that protrude from the handle surface. One or more switches in various convenient positions could operate one or more control arms, lines, racks, screws or other simple mechanical movement. A control wheel or gear operated by one or more fingers can also be used. Generally, a two-finger control with "pill-rolling" action, as in the illustrated embodiment, is convenient and natural. The joint piston (7) and socket (8) can be made larger and gearing can be used for mechanical advantage.

Spring or magnetic force is preferred to maintain the shaving angle position. A small battery in the handle could exert electromagnetic force by means of a finger tip switch. A switch system can be used so as to require deliberate action to change both shaving angles. Latches, detents, cog-stop and other systems can be used for docking. No finger action is then needed to maintain either blade unit position, and a safety brake is unnecessary. Spring or magnetic holding forces may then not be needed, but could be used to provide resistance or "feel" for the finger-tip controls.

Angular positions may be set and limited by docking means other than spring-slot and cog-stop systems. The braking teeth can be spaced to set the perpendicular angle, at the end of movement in one direction, and, in the other direction, to allow movement to rotate the blade-handle angle to at least one oblique position. The aperture for the finger-control bridge can be used to limit the longitudinal displacement of the control arms 12 and thereby limit the angle from perpendicular to the maximum oblique angle.

Yieldable, recoiling splines or spring-loaded cogs with slots are also feasible to limit shaving angles. These can be asymmetrical to allow rotation only between two positions or symmetrical to allow rotation to either side and for multiple positions. Latches, detents, cogs with stops and other means may be used.

The "joint" can be a simple snap spring or an elastic or yielding element. It can include a torsion spring as a connecting element to eliminate the need for other springs. Such a connecting element is fixedly attached at one end to the handle body (2) and, at the other end, to the rotating section of the handle neck (1).

Figure 7A:
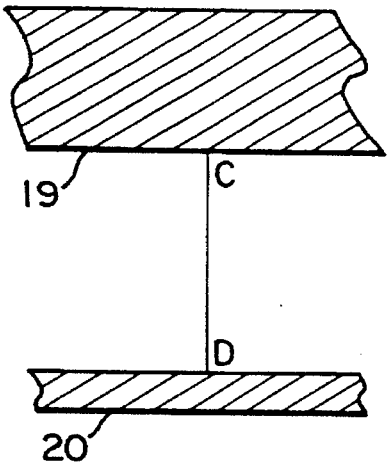
FIGS. 7A and 7B are diagrams which illustrate the change in effective distance between the blade edge and guard with oblique shaving.
Figure 7B:
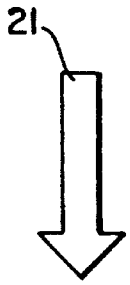
Figure 7B:
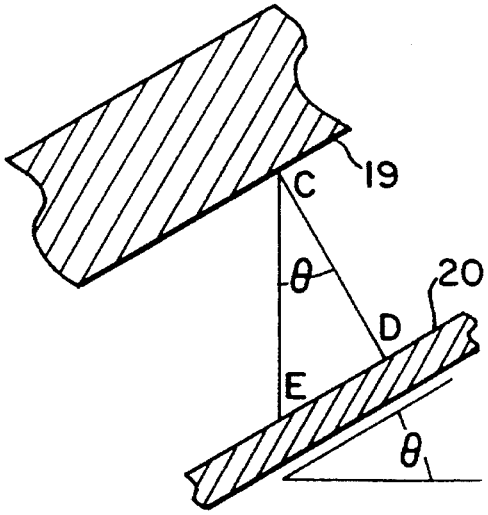

Disposable blade units may be modified specifically for this invention by reducing the distance between the blade guard and the blade edge. (Oblique shaving increases the effective blade-guard distance compared to the absolute distance by the reciprocal of the oblique angle's cosine, as illustrated by the diagrams in FIGS. 7A and 7B. The diagram represents a cross-section through a razor blade unit having a blade (19) and a guard (20). The absolute distance from the blade (19) to the guard (20) is CD. This is also the effective distance when the direction of the shaving stroke (large arrow 21) is perpendicular to the blade edge (FIG. 7A). Oblique shaving (FIG. 7B) at an angle Θ increases the effective blade-guard distance to CE. This refinement must be balanced against the effect on perpendicular shaving.

The entire razor may be made disposable. Plastic razors could be constructed with simple, two-position joints. Such joints can be deformable or elastic and controlled by one hand in normal shaving position. Necessary precision in angle settings, reliability and ease of control would be more difficult than with the preferred embodiment, and disposing of the entire razor might exceed the initial cost of a permanent handle.

Manufacture of the invention is not more difficult than for modern razors and cartridges. The illustrated embodiments can be made of hardened organic plastics, metals, alloys or other non-corrosive materials. The mount for the blade unit may be integral to the handle neck or bonded to it. The remainder of the handle neck with its piston extension can be a single element. The "U" ring can be bonded to the neck and snap into a track circling the adjacent end of the handle body. The handle body can be made in two longitudinally divided sections to allow assembly. The sections can be bonded chemically and also held together by decorative trim. Spring catches can be anchored by bonding, force-fitted or hooked into their recesses. Control arms can be plastic or metallic. Fiber or metallic control lines are feasible. Coil-spring units can be joined chemically or mechanically to the control arms and the base of the handle. Control bridges can be hardened plastic or metallic. Finger tip switches may be plastic or metallic, preferably of a color to contrast with the handle body.

The terms, expressions and drawings which have been employed are used as means of description and not of limitation, and there is no intention in the use of such means of excluding any equivalents of the features shown or described, or portions thereof, but it is recognized that various modifications are possible within the scope of the invention claimed.

I claim:

1. An improved safety razor having a handle for a shaver's grasp; a mount on said handle for a blade assembly; and a joint allowing said blade assembly to rotate relative to said handle, thereby changing the razor's shaving angle; wherein the improvement comprises:

docking means for positioning said blade assembly at a perpendicular shaving angle and a predetermined oblique shaving angle; and switching means for changing said razor's shaving angle, said switching means comprising a. a switch on said handle, said switch having an external excursion positioned within said shaver's grasp on said handle by one hand, whereby said switch is controllable by said one hand on said handle without displacement of said shaver's usual grasp on said handle, b. a torquing element operable to rotate said blade assembly, and c. connecting means for linking said switch and said torquing element, whereby said switch is operable to control said razor's shaving angle.

2. An improved safety razor having a handle for a shaver's grasp; a mount on said handle for a blade assembly; a joint allowing said blade assembly to rotate relative to said handle, thereby changing the razor's shaving angle; and docking means having a primary and a secondary position for reversibly setting said razor's shaving angle; wherein said joint has opposite functional sides and the improvement comprises:

automatic switch means for changing said razor's shaving angle, comprising:

a. resilient means for providing force unidirectionally from one functional side of said joint to the other functional side, b. a torquing element for directing the force to rotate said joint, and c. connecting means linking the resilient means and the torquing element, said connecting means transmitting force from said resilient means to said torquing element to urge said torquing element to rotate said blade assembly toward the primary docking position, whereby said automatic switching means acts to change said razor's shaving angle from said secondary docking position to said primary docking position without deliberate action, when the shaver does not act to maintain said secondary docking position.

3. An improved safety razor having a handle for a shaver's grasp; a mount for a blade assembly; and a joint allowing said blade assembly to rotate relative to said handle, thereby changing the razor's shaving angle; wherein the improvement comprises:

automatic braking means for impeding a change in said razor's shaving angle when the razor is held against a shaving surface, said automatic braking means comprising:

a. a razor part moving integrally with rotation of said blade assembly, b. a brake proximate to said razor part and operable in response to engagement of the razor against the shaving surface, said automatic braking means utilizing force resulting from holding said razor against the shaving surface to operate the automatic braking means to automatically engage said brake to prevent said razor's shaving angle from changing when the razor is held against the shaving surface.

4. An improved safety razor having a handle for a shaver's grasp; a mount for a single, unitary blade assembly; a joint allowing said blade assembly to rotate relative to said handle, thereby changing the razor's shaving angle; and docking means for reversibly setting the shaving angles; wherein:

a. said docking means position the blade assembly at a perpendicular angle and an oblique angle preselected for substantial shaving advantage and safety, b. said joint providing smooth transition between said oblique and perpendicular angles for preventing the positioning of the blade assembly at any angle therebetween, and;

c. said docking means including a catch to impede rotation past said perpendicular and efficient oblique angles, whereby the shaver can select, as desired, the perpendicular angle and the efficient oblique angle.

5. The improved safety razor of claim 3 wherein engagement of said brake impedes movement of said razor part.

6. The improved safety razor of claim 5 wherein said brake comprises first and second interlocking teeth.

7. The improved safety razor of claim 6 wherein said first interlocking teeth are connected to said razor part and said second interlocking teeth are connected to said handle.

8. A razor for shaving a skin surface comprising a razor handle having a gripped section with a longitudinal axis and a terminal joint section at one end, said joint section comprising a hollow cylindrical socket having a cylindrical axis perpendicular to the skin surface when the razor is positioned for use;

a razor blade unit comprising a blade holder, a skin-contacting guard, and a razor blade having a blade edge spaced parallel to said guard operable to shave across the skin surface when in use;

rotatable neck means mounting said razor blade unit on said joint section of the handle, in one position of said neck means said blade edge being perpendicular to the long axis of the gripped section of the handle for perpendicular shaving, and operable to be rotated in a plane parallel to the skin surface when the blade unit is positioned for use, said neck section having a cylindrical piston mounted for rotation in said socket;

said razor handle having switching means for rotating the neck means relative to the gripped section of said handle;

said switching means operable to displace said blade edge to an oblique angle to said gripped section for oblique shaving; and limit means to limit the rotation of the blade unit to a preselected allowable oblique angular position on at least one side of said perpendicular position, and to resiliently maintain said blade unit at said preselected oblique position, said limit means comprising catch and slot components on the respective confronting cylindrical surfaces of said socket and piston.

9. A razor as claimed in claim 8 wherein said catch and slot components are asymmetrical to prevent rotation of said piston in one direction from said oblique position away from said perpendicular position, but afford rotation of said piston in the opposite direction from said oblique position toward said perpendicular position.

* * * * *

UNITED STATES PATENT AND TRADEMARK OFFICE

CERTIFICATE OF CORRECTION

PATENT NO. : 5,526,568

DATED : June 18, 1996

INVENTOR(S) : COPELAN, Herbert W.

It is certified that errors appear in the above-identified patent and that said Letters Patent is hereby corrected as shown below:

Column 4, line 16, delete "(4)" and insert --(3)--;

Column 6, line 7, delete "can be used"; and

Column 7, line 25, after "CE.", insert --)--.

Signed and Sealed this

Twenty-second Day of April, 1997

Bruce Lehman

*Attest:*

BRUCE LEHMAN

*Commissioner of Patents and Trademarks*

*Attesting Officer*